US010973337B2

(12) United States Patent
Ermalovich et al.

(10) Patent No.: US 10,973,337 B2
(45) Date of Patent: Apr. 13, 2021

(54) COMPACT CARDRIDGE FAN SYSTM FOR ENVIRONMENTAL CONTROL IN AN ARTICULATING BED

(71) Applicant: ERGOMOTION, INC., Goleta, CA (US)

(72) Inventors: Joseph Ermalovich, Santa Barbara, CA (US); Brett Anthony Towe, Goleta, CA (US); Benjamin D. Harding, Santa Barbara, CA (US); Mario Gonzalez, Lexington, KY (US)

(73) Assignee: ergomotion, inc., Goleta, CA (US)

( * ) Notice: Subject to any disclaimer, the term of this patent is extended or adjusted under 35 U.S.C. 154(b) by 355 days.

(21) Appl. No.: 16/023,642

(22) Filed: Jun. 29, 2018

(65) Prior Publication Data

US 2020/0000242 A1 Jan. 2, 2020

(51) Int. Cl.

| | |
|---|---|
| ***A47C 21/04*** | (2006.01) |
| ***A61G 7/015*** | (2006.01) |
| ***A47C 17/04*** | (2006.01) |
| ***A47C 20/04*** | (2006.01) |
| ***A61G 7/057*** | (2006.01) |

(52) U.S. Cl.

CPC ..... *A47C 21/044* (2013.01); *A47C 17/04* (2013.01); *A47C 20/04* (2013.01); *A47C 21/048* (2013.01); *A61G 7/015* (2013.01); *A61G 7/05784* (2016.11)

(58) Field of Classification Search

CPC ..... A47C 21/044; A47C 21/048; A47C 7/74; A47C 7/744; A47C 21/04; A47C 20/04; A47C 21/042; F24F 2221/10; A61G 7/05784; A61G 7/05792; A61G 2210/70; A61G 2210/90; A61G 7/015

See application file for complete search history.

(56) References Cited

U.S. PATENT DOCUMENTS

| | | | | |
|---|---|---|---|---|
| 2,703,134 A * | 3/1955 | Mossor | A47C 7/74 297/180.14 |
| 4,450,756 A * | 5/1984 | Kling | F24C 15/2028 126/299 D |
| 4,662,912 A * | 5/1987 | Perkins | F24F 3/1603 454/230 |
| 6,003,950 A * | 12/1999 | Larsson | A47C 7/74 297/452.42 |
| 6,048,024 A * | 4/2000 | Wallman | A47C 7/74 297/180.14 |
| 7,261,372 B2 * | 8/2007 | Aoki | B60N 2/5657 297/180.14 |

(Continued)

FOREIGN PATENT DOCUMENTS

WO WO-2008046110 A2 * 4/2008 ..... A47C 21/044

*Primary Examiner* — Eric J Kurilla
*Assistant Examiner* — Amanda L Bailey
(74) *Attorney, Agent, or Firm* — Felix L. Fischer

(57) ABSTRACT

A compact cartridge fan system for use in an articulating bed structure having a stationary horizontal support panel includes a frame adapted to be engaged in a receiving aperture in the stationary horizontal support panel. A cartridge is removably received in a receiving aperture in the frame. The cartridge has a case containing a box fan and a connector attachment. A connector is engaged in the connector attachment and adapted to be received through a mattress base supported on the stationary support panel.

12 Claims, 12 Drawing Sheets

(56) References Cited

U.S. PATENT DOCUMENTS

| | | | | |
|---|---|---|---|---|
| 8,181,290 | B2 * | 5/2012 | Brykalski | A61G 7/05 5/423 |
| 8,782,830 | B2 * | 7/2014 | Brykalski | A47C 21/048 5/423 |
| 8,998,311 | B2 * | 4/2015 | Axakov | B60N 2/68 297/180.14 |
| 9,694,716 | B2 * | 7/2017 | Masuda | B60N 2/565 |
| 10,406,950 | B2 * | 9/2019 | Yang | B60N 2/5657 |
| 2008/0148481 | A1 * | 6/2008 | Brykalski | A47C 21/048 5/423 |
| 2011/0115635 | A1 * | 5/2011 | Petrovski | A61G 7/05 340/584 |
| 2014/0201919 | A1 * | 7/2014 | Albero | A61G 7/057 5/644 |
| 2015/0289667 | A1 * | 10/2015 | Oakhill | A47C 21/044 5/423 |
| 2016/0166073 | A1 * | 6/2016 | Oakhill | A47C 21/048 5/613 |
| 2017/0360212 | A1 * | 12/2017 | Rawls-Meehan | A47C 19/025 |
| 2018/0242753 | A1 * | 8/2018 | Ghanei | A47C 27/056 |

* cited by examiner

COMPACT CARDRIDGE FAN SYSTM FOR ENVIRONMENTAL CONTROL IN AN ARTICULATING BED

BACKGROUND

Field

This invention relates generally to the field of articulating beds and more particularly to an environmental control system for an articulating bed having a compact cartridge fan system for close engagement in a horizontal support section of the bed.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping. Typical articulating beds provide an upper body positioning element and a thigh and lower leg positioning element either individually active or with combined actuation.

New foam mattresses typically employed with articulating beds make overheating or, in certain occasions overcooling of the occupant during sleep. Environmental control systems are being introduced to cool or heat the mattress or provide heated or cooled airflow to maintain comfortable sleeping conditions. However, designs of modern bedding require a reduced thickness profile and reduced movement of ancillary components is preferable.

It is therefore desirable to provide an articulating bed having an environmental control system that minimally impacts operation of the articulation system of the bed.

SUMMARY

The embodiments disclosed herein overcome the shortcomings of the prior art by providing a compact cartridge fan system for use in an articulating bed structure having a stationary horizontal support panel. The system includes a frame adapted to be engaged in a receiving aperture in the stationary horizontal support panel. A cartridge is removably received in a receiving aperture in the frame. The cartridge has a case containing a box fan and a connector attachment. A connector is engaged in the connector attachment and adapted to be received through a mattress base supported on the stationary support panel.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
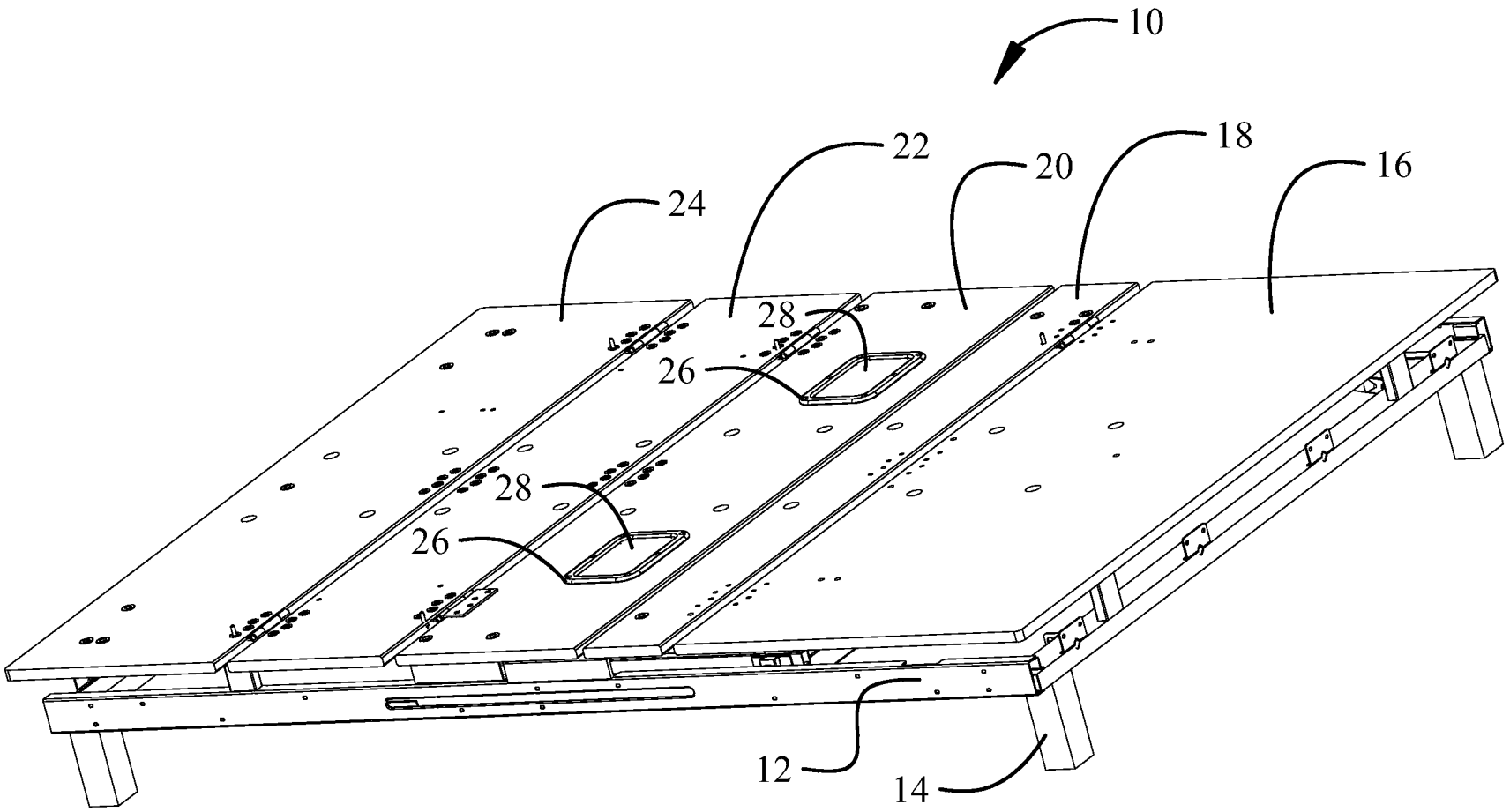
FIG. 1 is An upper pictorial representation of an articulating bed system in which implementations described herein may be employed.

Implementations shown in the drawings and described herein provide a compact cartridge fan system which is easily integrated into an articulating bed structure. The cartridge fan system is engaged in a stationary horizontal support panel in the articulating structure. A frame is inserted through an aperture in the horizontally fixed support element for each desired cartridge. In the implementation shown and described herein, two cartridges are employed but a larger plurality of cartridges may be used in alternative implementations. A cartridge incorporating a box fan and a filter bracket supported in a case having resilient engagement elements is received in the frame and depends from the stationary horizontal support element intermediate structural and actuating elements of the articulating bed structure. The case incorporates a connector attachment, in flow communication with the fan, into which a vertical connector is received. The connector protrudes through a mating aperture on a mattress base resting on the stationary horizontal support panel. Air drawn into the cartridge by the fan flows through the filter element, connector attachment and connector to provide distribution of environmental air flow. A piezo electric cooling and heating block may be positioned intermediate the filter element and box fan to cool or heat the incoming air prior to distribution from the cartridge.

FIG. 1 of the drawings shows an exemplary articulating bed structure 10 in which the exemplary implementations of the compact cartridge fan system may be employed. The articulating bed structure 10 incorporates a frame 12 supported by legs 14. An upper body support panel 16 is pivotally attached to a first horizontal seat support 18. The upper body support panel may be articulated to raise a portion of a supported mattress as will be described subsequently. For the particular articulating bed structure 10 the first horizontal seat support and upper body support panel are mounted on a translating carriage to provide a wall hugging effect as disclosed in U.S. patent application Ser. No. 15/752,578 and was filed on Feb. 13, 2018 entitled ELECTRIC, the disclosure of which is incorporated herein by reference. A stationary horizontal support panel 20 is mounted to the frame 12. Thigh support panel 22 is pivotally attached to the stationary horizontal support panel for articulation and a lower leg support panel 24 is pivotally attached to the thigh support panel. Articulation of the thigh and lower leg support panels may be accomplished as is well known in the art.

Figure 2:
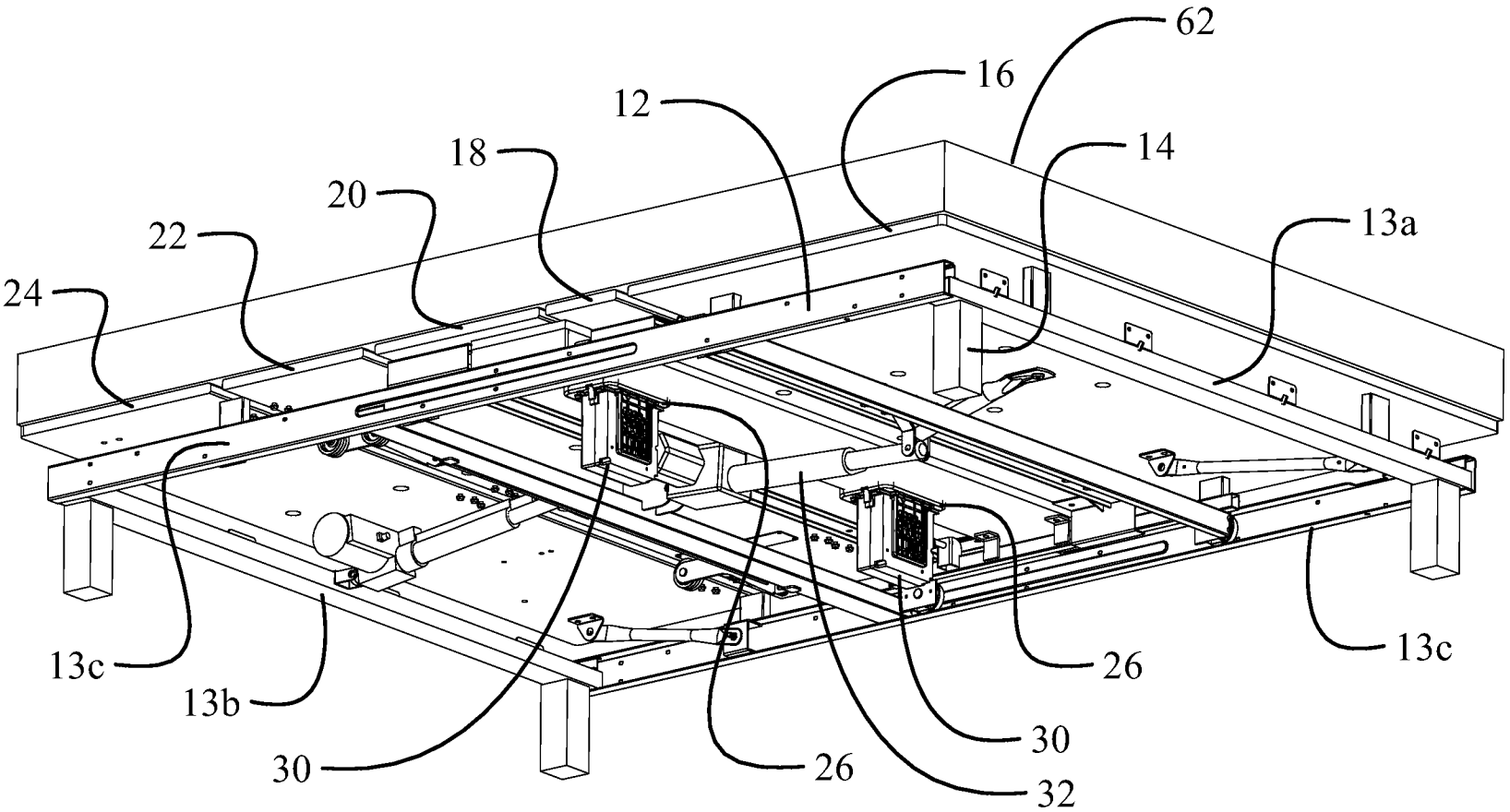
FIG. 2 is a lower pictorial representation of the articulating bed system of FIG. 1 with the cartridges installed.

For each compact cartridge fan system a frame 26 having a central aperture 28 is inserted through an appropriately sized receiving aperture 29 in the stationary horizontal support panel 20. As seen in FIG. 2, a cartridge 30 is inserted into and depends from the frame 26. The cartridge 30 is positioned by the frame 26 to rest in open volume under the support panels between the frame elements and with clearance from articulating structure elements such as upper body panel actuator assembly 32. While shown for the exemplary implementation as aligned parallel to the head end frame element 13*a* and foot end frame element 13*b*, the cartridges 30 and associated frames 20 may be oriented parallel to the side frame elements 13*c*.

Figure 3:
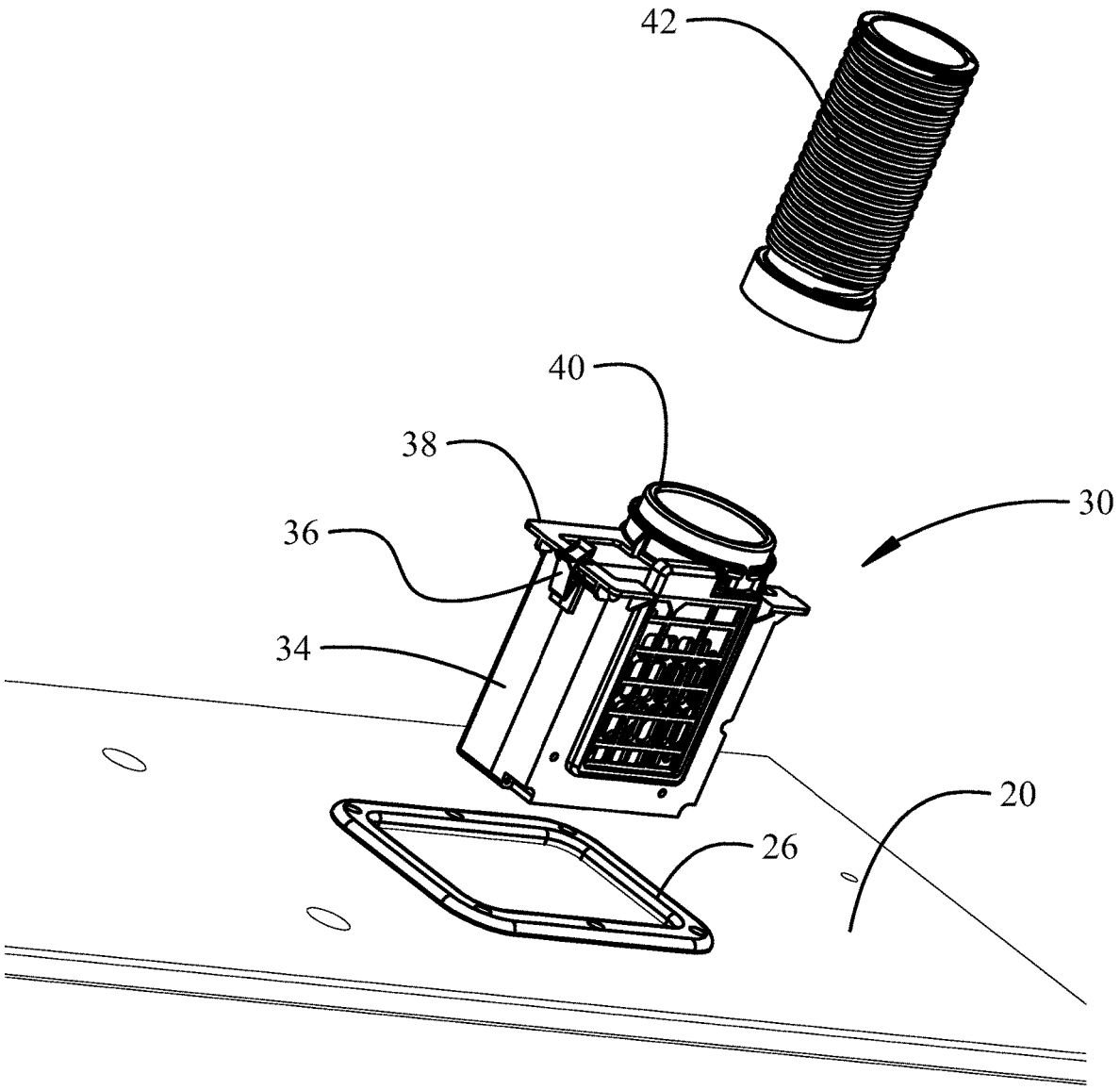
FIG. 3 is an upper pictorial representation of the frame installed in the fixed seat support, the cartridge and the connector.
Figure 4:
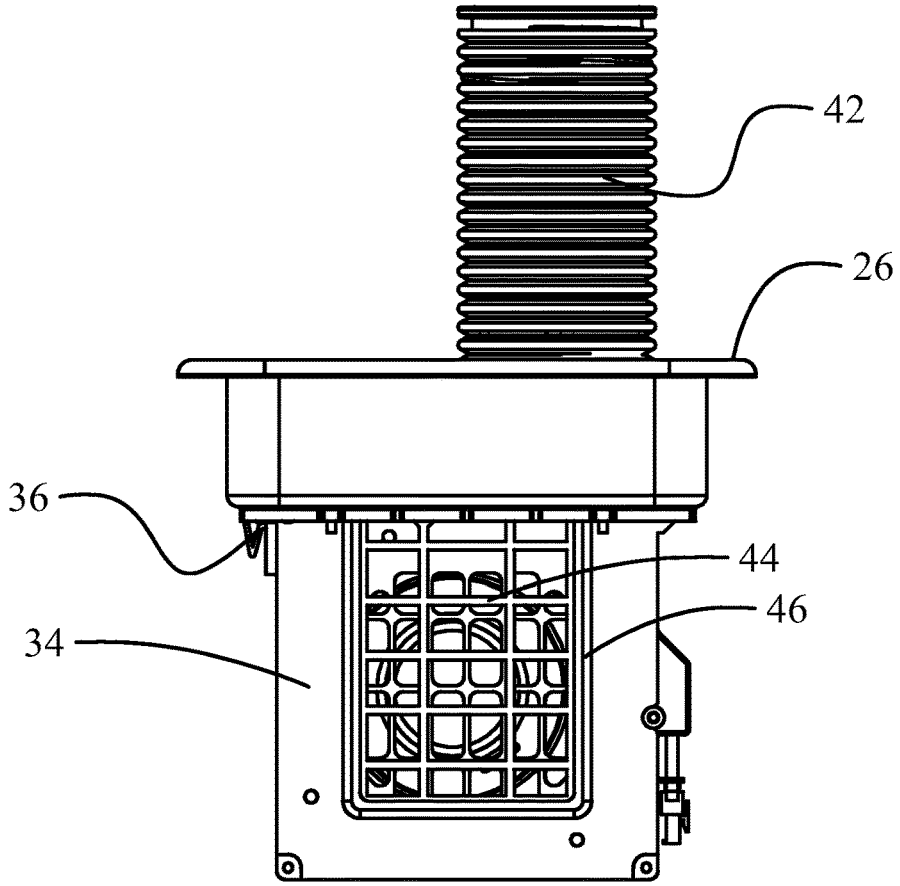
FIG. 4 is a side view of the frame, cartridge and connector.
Figure 5:
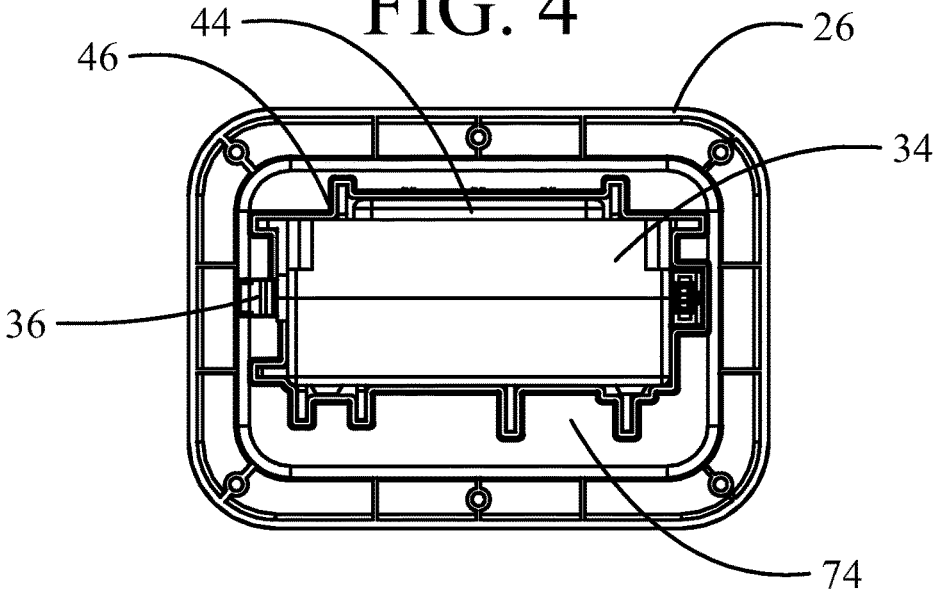
FIG. 5 is a bottom view of the frame and cartridge.
Figure 6:
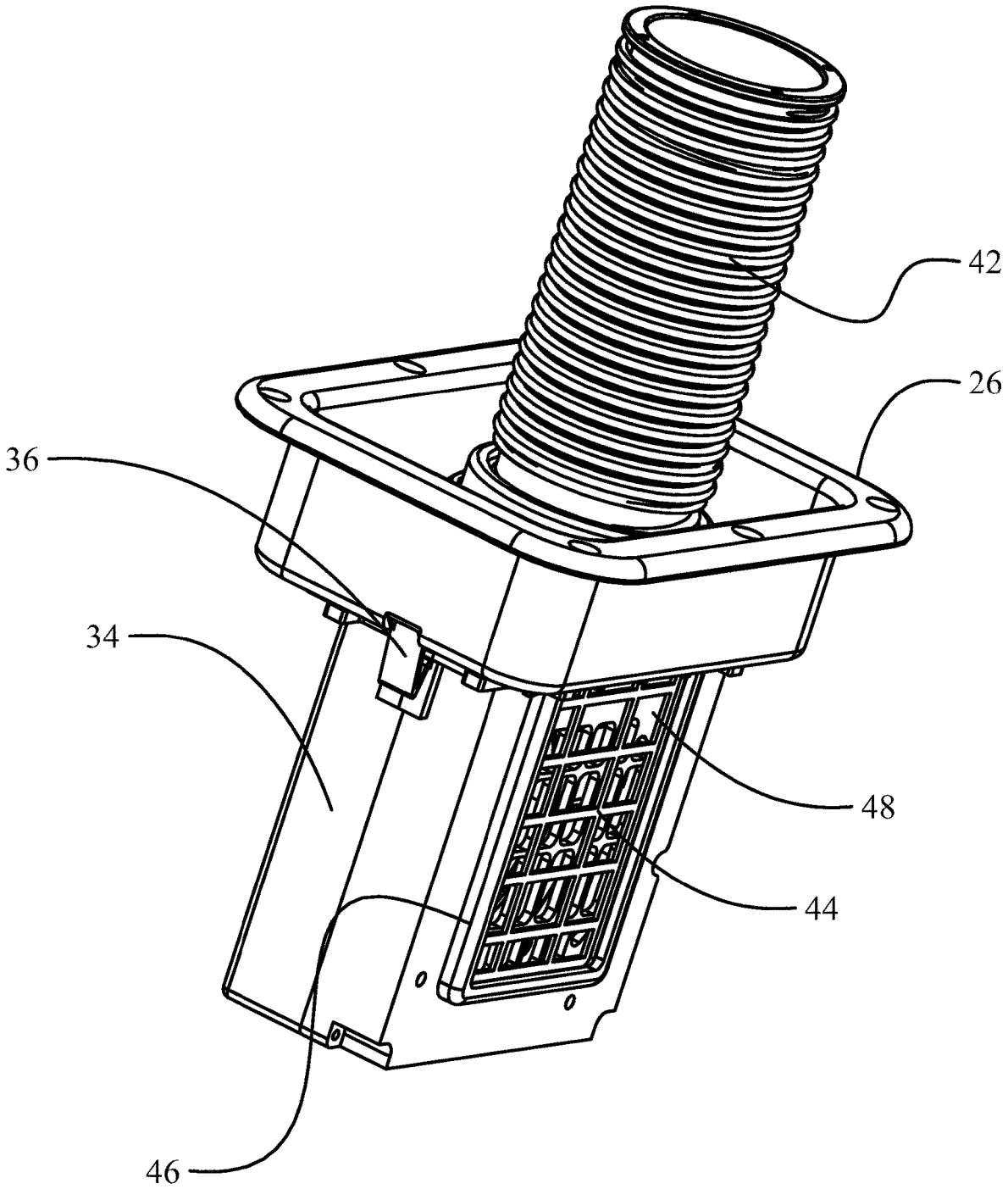
FIG. 6 is an upper head end pictorial representation of the frame, cartridge and connector.
Figure 7:
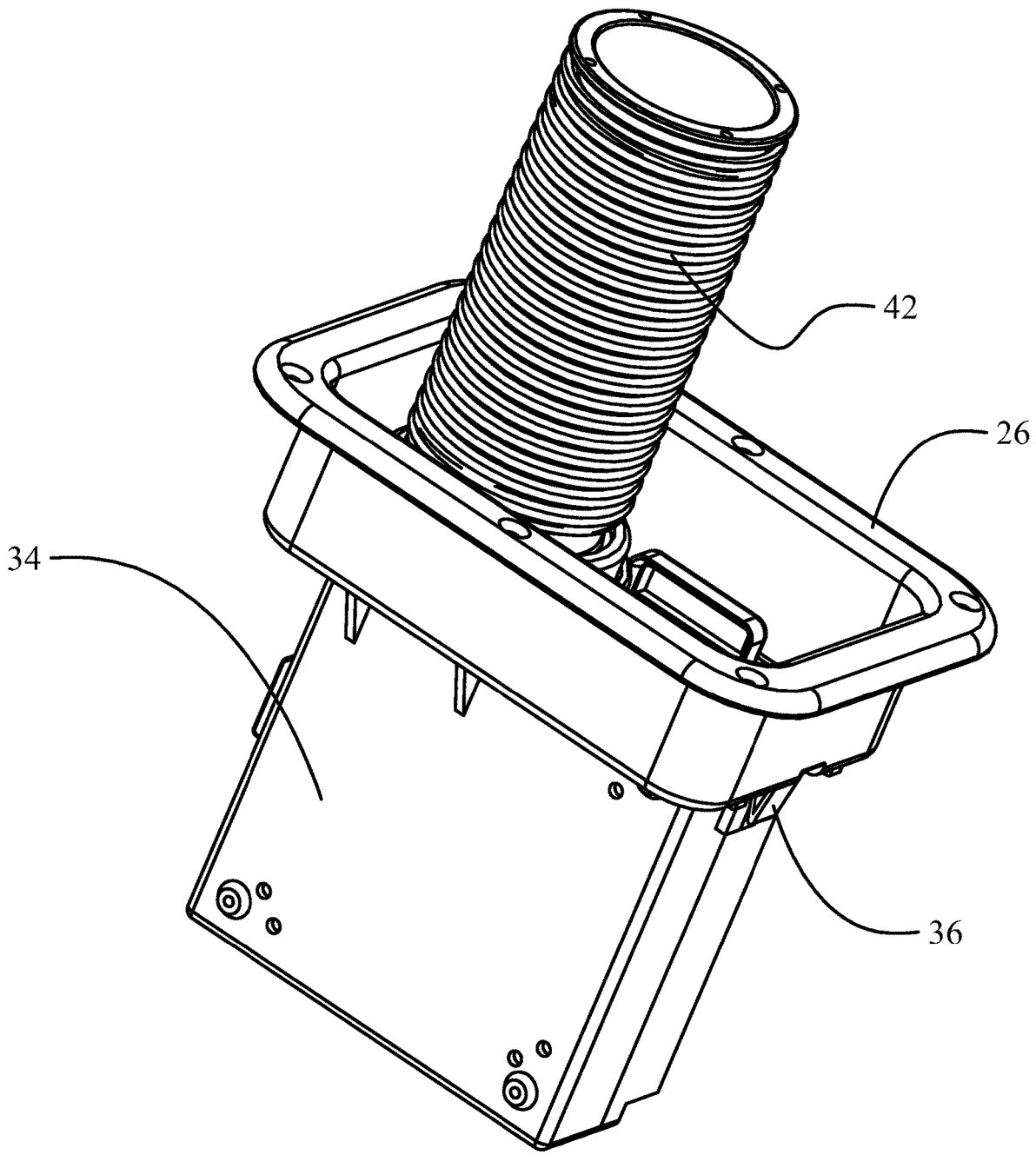
FIG. 7 is an upper foot end pictorial representation of the frame, cartridge and connector.
Figure 8:
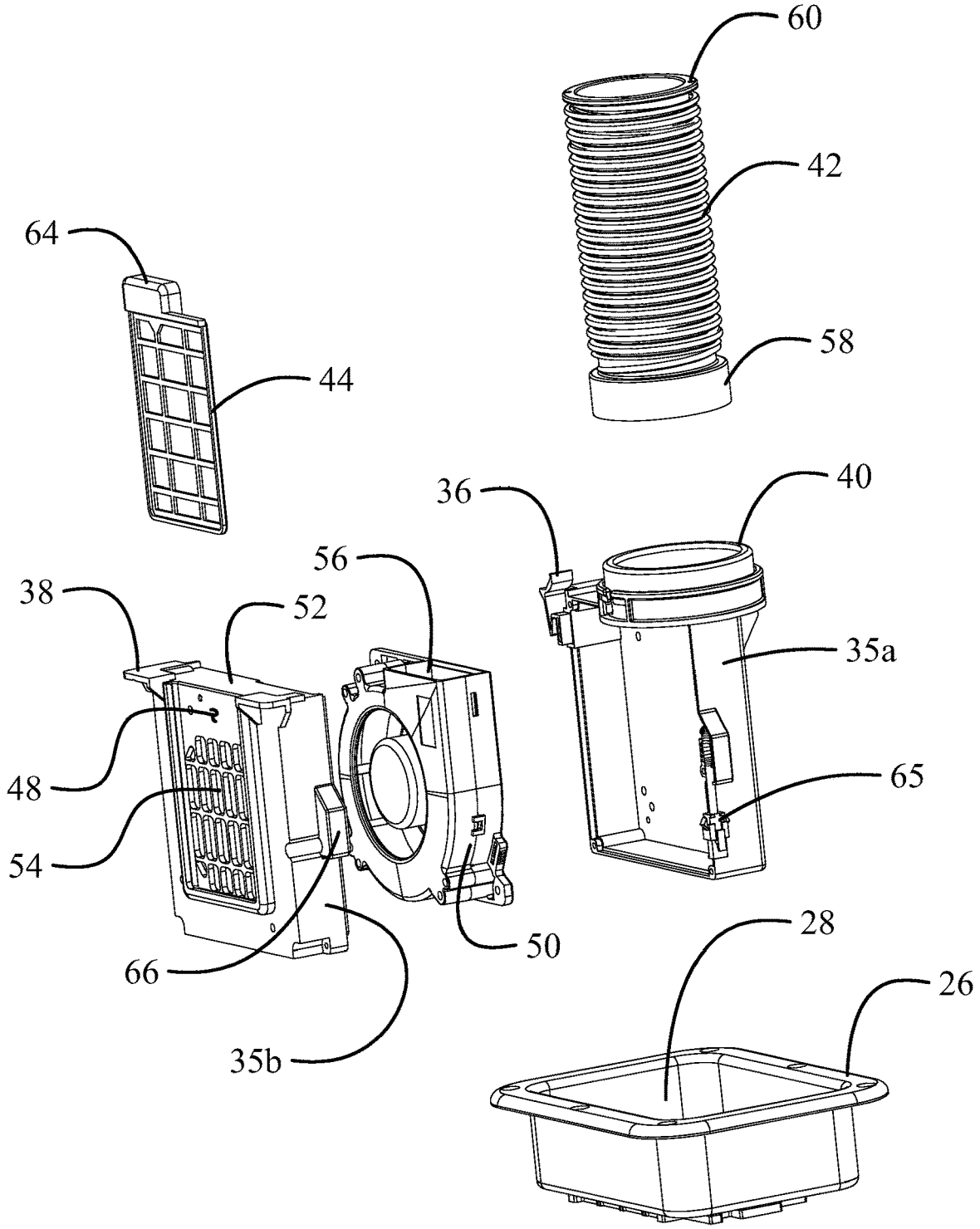
FIG. 8 is an exploded pictorial representation of the elements of the cartridge fan system.

As seen in FIG. 3, the cartridge 30 has a case 34 with at least one resilient engagement element 36 and an upper flange 38 to be received in the frame 26. A connector attachment 40 is adapted to receive a connector 42 to provide flow distribution through a mattress base 62 (seen in FIG. 2). Details of the cartridge fan system are seen in FIGS. 4-7. Case 34 incorporates a filter 44 (shown only as the support matrix or bracket but without the filter element for clarity) which is received in an engagement slot 46 which surrounds an inlet aperture 48. As seen in FIG. 8 which shows the internal elements of the cartridge 30, the case 34 is split into two halves 35*a* and 35*b* to receive a box fan 50. A piezoelectric cooling/heating element 52 is inserted between the inlet aperture 48 and the box fan 50. The piezoelectric cooling/heating element 52 has a plurality of flow channels 54 through which air entering from the inlet aperture 48 flows to be cooled or heated (with the element operational) or merely transitioned to the box fan for distribution. The box fan outlet 56 is oriented upwards and aligned for flow communication with the connector attachment 40 on the top of the case 34. The connector 42 has an attachment ring 58 adapted to be received in the connector attachment 40. While shown as substantially cylindrical in the exemplary implementation the flow conduits created by the connector 42 and connector attachment 40 may have other geometric cross sectional shape. The connector additionally has a top flange 60 which is employed to engage a top surface of the mattress base 62 as will be described in greater detail subsequently.

The filter 44 is easily removable, without disassembly or removal of the cartridge from the frame, for cleaning or replacement by sliding vertically out of the engagement slot 46 in the case 34. The engagement slot 46 opens into the aperture 28 and a tab 64, which extends into the aperture 28 within the frame 26, is provided to facilitate insertion and removal. Electrical power connectors 65 for the box fan 50 and piezoelectric cooling and heating element 52 is provided at a electrical connection port 66 in a side of the case. Electrical connection of the fan and piezoelectric cooling/heating element are conventional and not shown for clarity.

Figure 9:
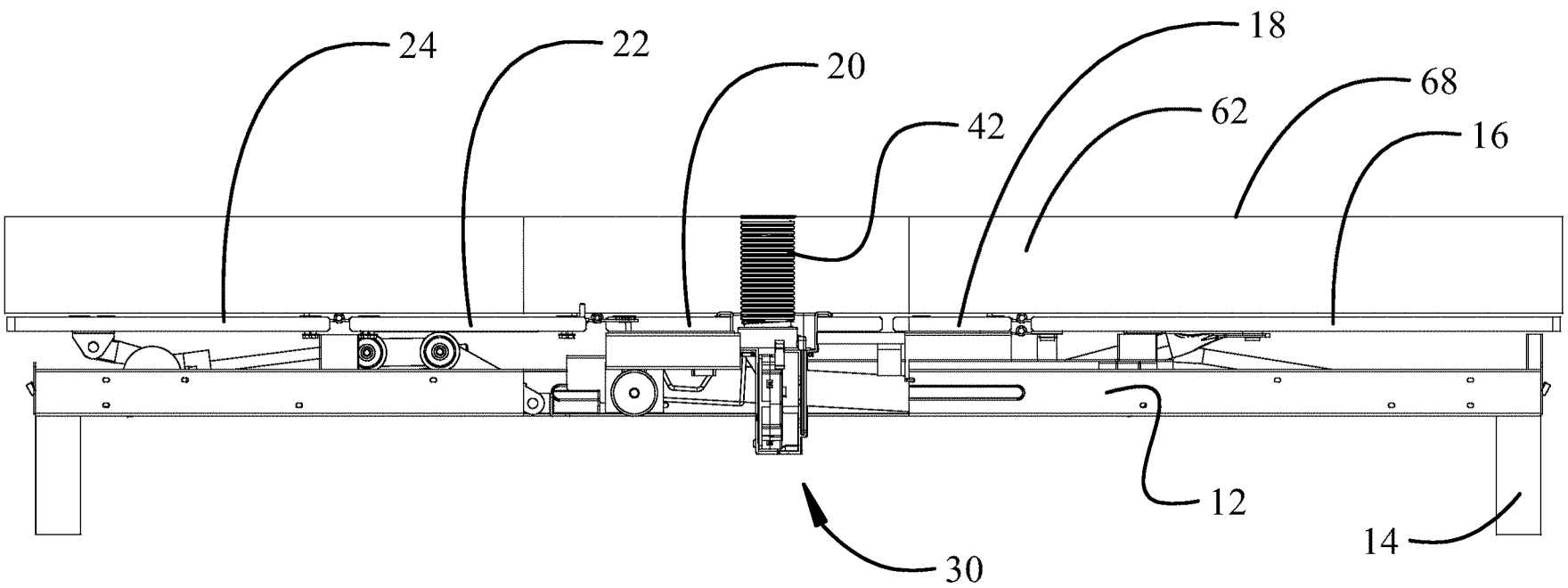
FIG. 9 is a side partial section view of the articulating bed system and mattress base showing the cartridge fan system as installed.
Figure 10:
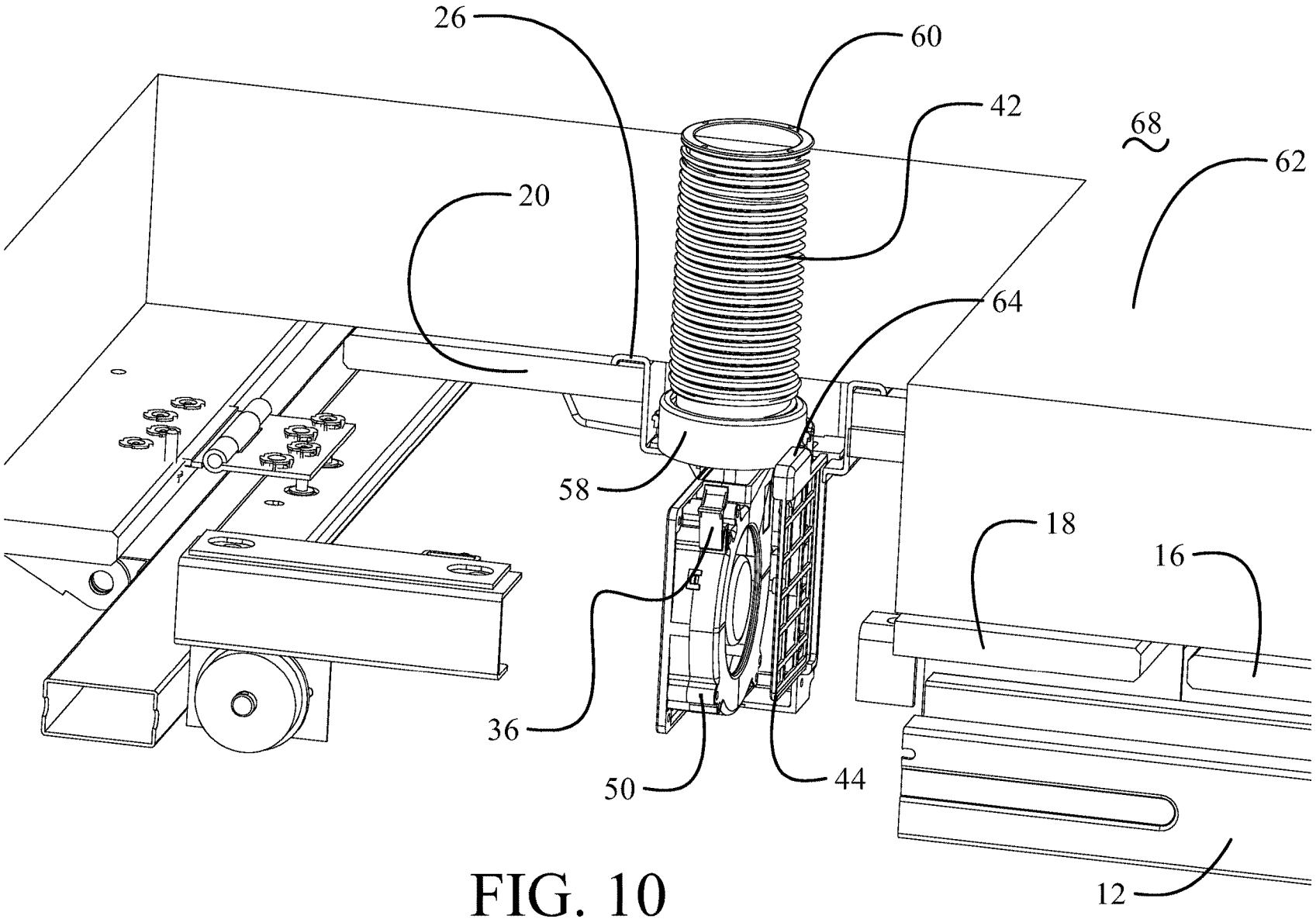
FIG. 10 is a pictorial detailed section view of the articulating bed system and mattress base showing the cartridge fan system as installed.
Figure 11:
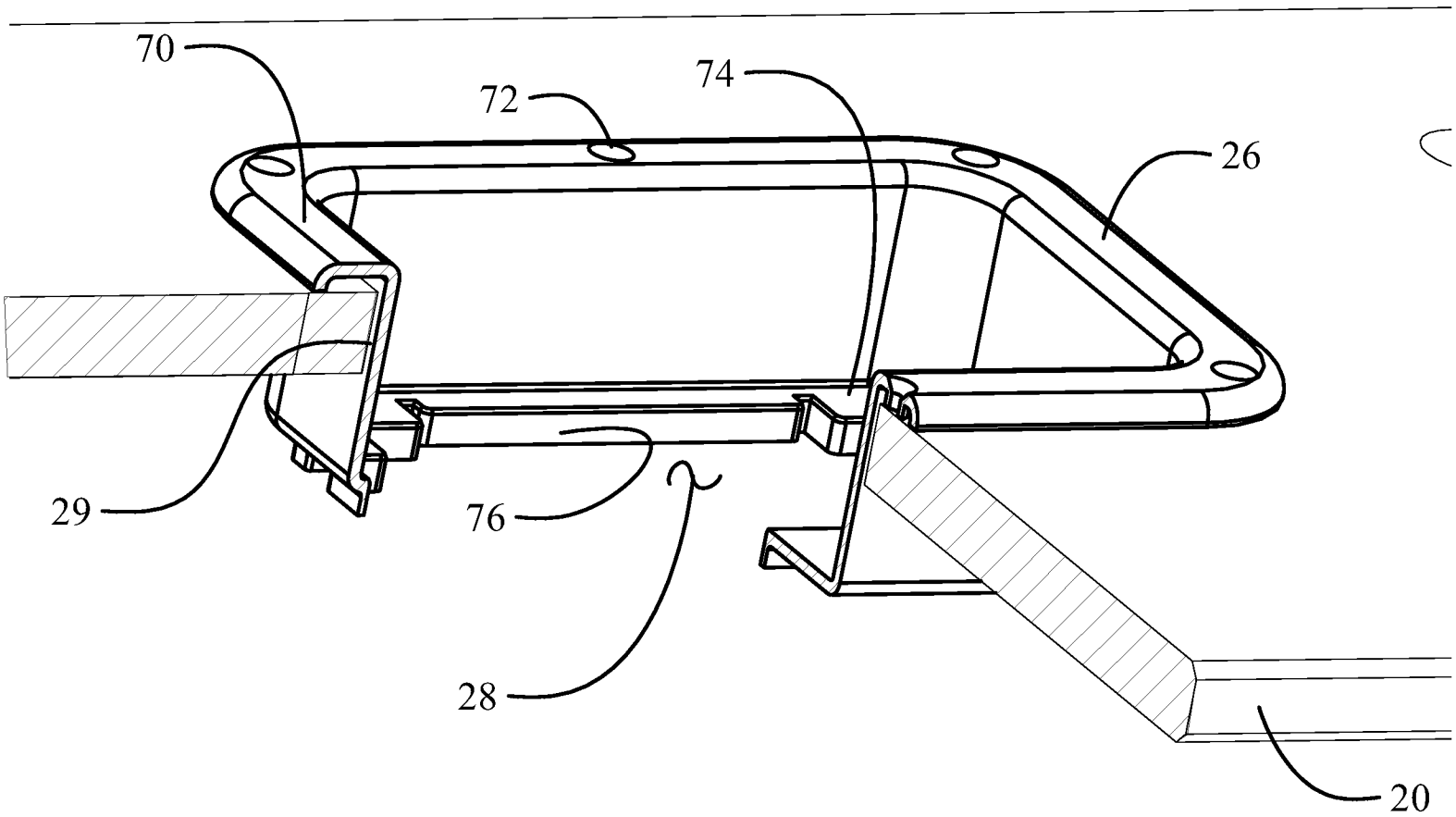
FIG. 11 is a detailed partial section view of the frame as installed in the fixed seat support.

As seen in FIGS. 9 and 10, the cartridge 30 is supported in the frame 26 and depends into open volume in the articulating bed structure. The cartridge 30 is removably inserted in the frame 26 prior to placement of the mattress base 62 onto the support panels 16, 18, 20, 22 and 24. The cartridge 30 is also easily removable from the frame 26 by disengaging the resilient engagement element 36 and lifting the cartridge upward through the aperture 28 in the frame 26. As seen in FIG. 11, the frame 26 is engaged in the receiving aperture 29 in the stationary horizontal support 20. The frame 26 includes an upper lip 70 extending over the periphery of the receiving aperture 29 with holes 72 through which screws or other fasteners are received to secure the frame to the support. The frame 26 additionally includes a peripheral bottom web 74 (also seen in FIG. 5) which is adapted to closely receive the cartridge 30 and engage the upper flange 38 to support the cartridge in the frame. A relief 76 in the web 74 exposes the filter 44 for insertion and removal as previously described.

Returning to FIGS. 9 and 10, the connector 42, for the exemplary implementation, is a spirally corrugated tube nominally sized to accommodate a thickness of the mattress base 62 but allowing flexible extension during installation allowing attachment ring 58 to be easily inserted into the connector attachment 40 when mattress base 62 is placed on the support panels of the articulating bed structure. The top flange 60 of the connector is adapted to be secured to an upper surface 68 of the mattress base 62.

Figure 12:
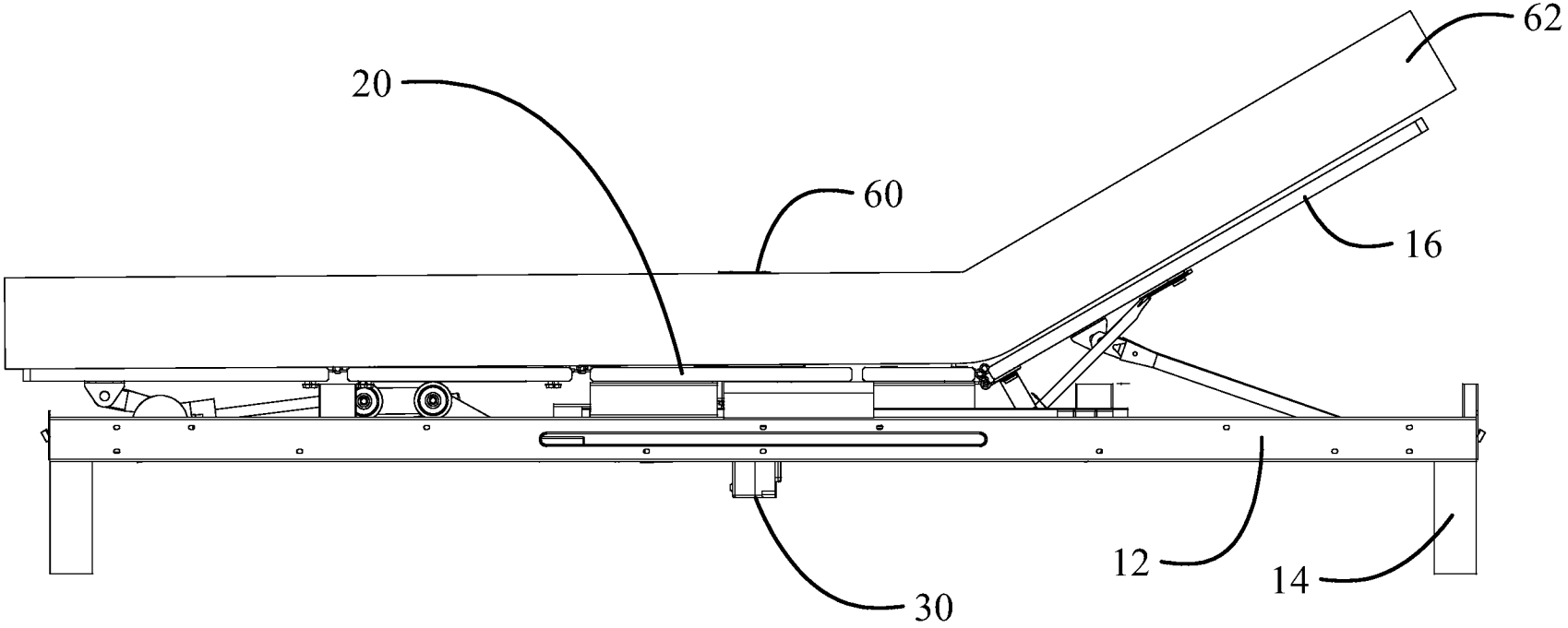
FIG. 12 is a side view of the articulating bed with the head support in an articulated position.
Figure 13:
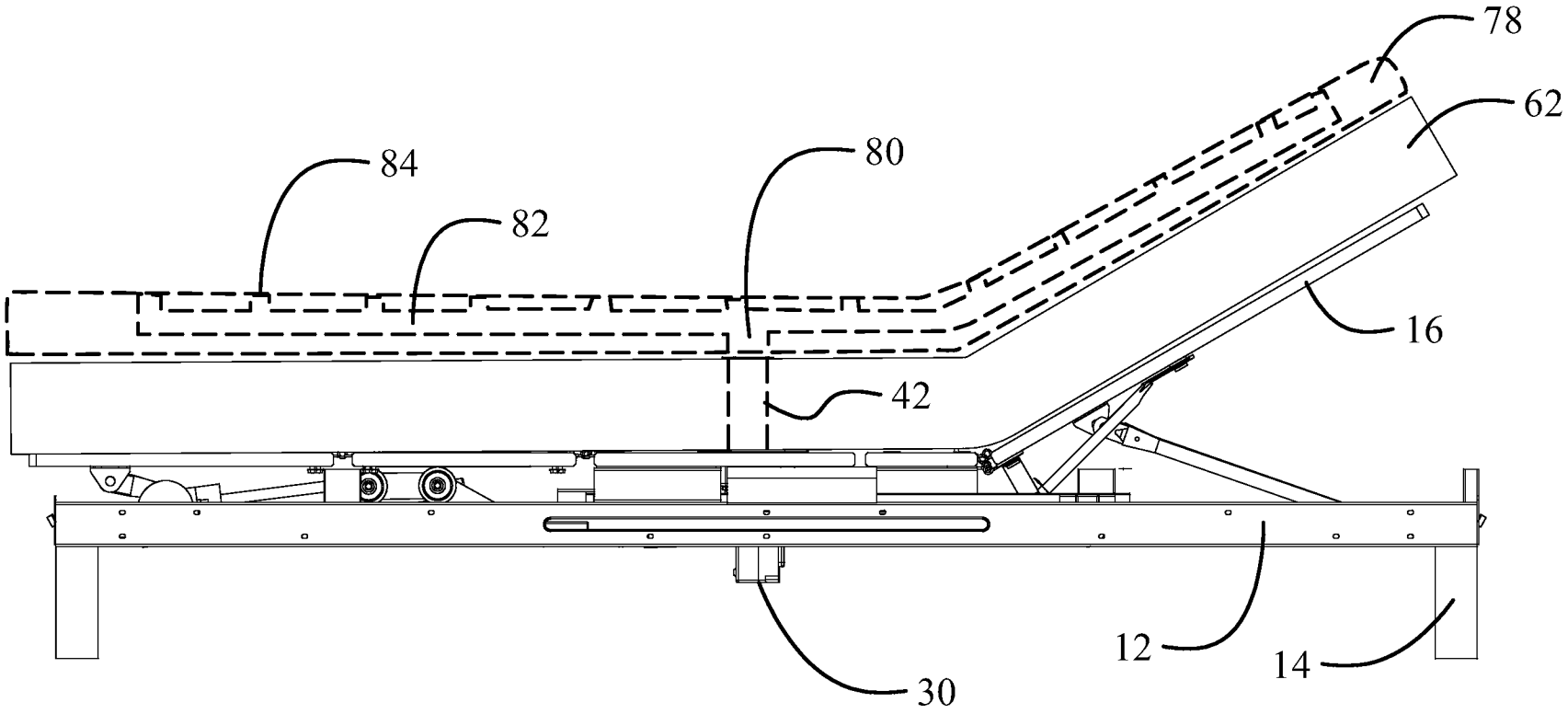
FIG. 13 is a side view of the articulating bed with the head support in an articulated position showing an exemplary mattress top pad with flow channels and interconnection with the cartridge fan system connector shown in phantom.

As seen in FIGS. 12 and 13, articulation of the upper body support panel 16 to elevate the head portion of the mattress base 62 does not created substantial motion in the mattress base over the stationary horizontal support 20. Minor movement can be accommodated by the flexible corrugations of connector 42. A flow distribution pad 78, shown as an exemplary notional implementation in phantom in FIG. 13, is received on top of the mattress base 62. An air inlet 80 in the flow distribution pad 78 is positioned over the connector 42 extending through the mattress base 62. A plurality of flow channels 82 in flow connection with the air inlet 80 extend through the flow distribution pad 78 terminate in air outlets 84 disbursed over the surface of the flow distribution pad providing heated, cooled or ambient air from the compact cartridge fan system.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A compact cartridge fan system for use in an articulating bed structure having a stationary horizontal support panel, the system comprising:

a frame adapted to be engaged in a receiving aperture in the stationary horizontal support panel;

a cartridge removably received in a receiving aperture in a frame, said cartridge having a case containing a box fan and a connector attachment, the case with at least one resilient engagement element and an upper flange removably received in a receiving aperture in the frame, the case further incorporating a filter received in an engagement slot surrounding an inlet aperture;

a piezoelectric cooling/heating element inserted between the inlet aperture and the box fan, the piezoelectric cooling/heating element having a plurality of flow channels through which air entering from the inlet aperture flows is cooled or heated in a first operational condition or merely transitioned to the box fan for distribution in a second operational condition; and, a connector engaged in the connector attachment and adapted to be received through a mattress base supported on the stationary support panel.

2. The compact cartridge fan system as defined in claim 1 wherein the connector has an attachment ring adapted to be received in the connector attachment and a top flange adapted to engage a top surface of the mattress base.

3. The compact cartridge fan system as defined in claim 2 wherein the connector is a flexible corrugated tube.

4. The compact cartridge fan system as defined in claim 3 wherein the connector is cylindrical.

5. The compact cartridge fan system as defined in claim 3 wherein the frame includes an upper lip adapted to extend over a periphery of the receiving aperture with holes through which screws or other fasteners are received to secure the frame to the support, said frame additionally including a peripheral bottom web adapted to closely receive the cartridge and engage the upper flange to support the cartridge in the frame.

6. The compact cartridge fan system as defined in claim 5 wherein the case comprises a first half portion adapted to separably receive a second half portion to removably engage the box fan.

7. The compact cartridge fan system as defined in claim 1 wherein the filter is removable, without disassembly or removal of the cartridge from the frame, by sliding vertically out of the engagement slot in the case, said engagement slot opening into the receiving aperture, said filter including a tab extending into the receiving aperture within the frame.

8. An articulating bed structure comprising:

an articulation system having at least a support frame, an upper body support panel, said upper body support panel rotatable from a horizontal position to a raised position, a stationary horizontal support panel and a mattress support base supported on the upper body support panel and the stationary horizontal support panel; and, at least one compact cartridge fan system adapted to supply environmentally conditioned air through the mattress support base, said compact cartridge fan system incorporating a frame adapted to be engaged in a receiving aperture in the stationary horizontal support panel, the frame including an upper lip adapted to extend over a periphery of the receiving aperture with holes through which screws or other fasteners are received to secure the frame to the support panel;

a cartridge removably received in a receiving aperture in the frame, cartridge, said cartridge having a case containing a box fan and connector attachment, the case having at least one resilient engagement element and an upper flange to be received on the peripheral bottom web in the frame, the case incorporating a filter received in an engagement slot surrounding an inlet aperture wherein the filter is removable, without disassembly or removal of the cartridge from the frame, by sliding vertically out of the engagement slot in the case, said engagement slot opening into the receiving aperture, said filter including a tab extending into the receiving aperture within the frame; and, a connector engaged in the connector attachment and adapted to be received to extend through the mattress base.

9. The articulating bed structure as defined in claim 8 further comprising a piezoelectric cooling/heating element inserted between the inlet aperture and the box fan, the piezoelectric cooling/heating element having a plurality of flow channels through which air entering from the inlet aperture flows is cooled or heated in a first operational condition or merely transitioned to the box fan for distribution in a second operational condition.

10. The articulating bed structure as defined in claim 9 wherein the connector has an attachment ring adapted to be received in the connector attachment and a top flange adapted to engage a top surface of the mattress base.

11. The articulating bed structure as defined in claim 10 further comprising a flow distribution pad received on top of the mattress base, said flow distribution pad having an air inlet positioned over the connector extending through the mattress base.

12. The articulating bed structure as defined in claim 11 wherein the flow distribution pad further incorporates a plurality of flow channels in flow connection with the air inlet and extending through the flow distribution pad , said plurality of flow channels terminating in air outlets disbursed over the surface of the flow distribution pad thereby providing heated or cooled air in the first operational condition or ambient air in the second operational condition from the cartridge.

* * * * *